United States Patent [19]

Liljekvist et al.

[11] 4,399,879

[45] Aug. 23, 1983

[54] BORING HEAD

[75] Inventors: Bernt S. Liljekvist; Anders E. Persson, both of Sandviken, Sweden

[73] Assignee: Santrade Ltd., Lucerne, Switzerland

[21] Appl. No.: 267,653

[22] Filed: May 27, 1981

Related U.S. Application Data

[63] Continuation-in-part of Ser. No. 114,339, Jan. 23, 1980, Pat. No. 4,274,496.

[30] Foreign Application Priority Data

Feb. 2, 1979 [SE] Sweden ..... 7900922

[51] Int. Cl.[3] ..... E21B 10/22; F16C 19/40; F16C 19/49

[52] U.S. Cl. ..... 175/372; 175/53; 384/95

[58] Field of Search ..... 175/372, 371, 366, 367, 175/369, 359, 356, 53; 308/8.2; 384/92, 95

[56] References Cited

U.S. PATENT DOCUMENTS

| | | | |
|---|---|---|---|
| 2,047,112 | 7/1936 | Reed | 175/372 X |
| 3,612,197 | 10/1971 | Motoyama | 175/372 X |
| 4,142,598 | 3/1979 | Maxsted | 175/53 X |
| 4,213,656 | 7/1980 | Olschewski et al. | 308/8.2 |
| 4,258,806 | 3/1981 | Kunkel et al. | 175/372 X |

*Primary Examiner*—Stephen J. Novosad

*Attorney, Agent, or Firm*—Burns, Doane, Swecker & Mathis

[57] ABSTRACT

A boring head for reaming a pre-drilled hole in raise boring or for similar earth cutting operations comprising a plurality of roller cutters (13, 14), each of which being rotatably journalled over a bearing system. The bearing system comprises a split roller bearing (60) having axially spaced rollers (62, 63) which are separated by a loose guide ring (69).

8 Claims, 6 Drawing Figures

BORING HEAD

This is a continuation-in-part of application Ser. No. 114,339, filed Jan. 23, 1980, and now U.S. Pat. No. 4,274,496.

The invention relates to a boring head for rotary boring of the face of earth formations comprising a plurality of roller cutters which are rotatably journalled on bearing shafts over a bearing system. The bearing shaft is carried by a mounting means on the boring head and the bearing system comprises a roller bearing which has rollers spaced in the longitudinal direction of the roller cutter. The invention relates generally to earth boring, but is particularly intended for raise boring. In raise boring a pilot hole is drilled between a lower level and an upper level in a mine, whereupon the pilot hole is enlarged by means of a reaming head having a large diameter.

In prior art boring heads of this type the axially spaced rollers are separated by a flange which is integral with the bearing shaft or the roller cutter. A boring head of this type is shown in U.S. Pat. No. 3,749,188. In the member having the flange, thus, there must be provided two separate races.

The object of the invention is to set forth a boring head having a single race on both the bearing shaft and the roller cutter for all the rollers in the roller bearing. In comparison with a boring head having two separate races the following advantages are obtained:

1. A single race—a loose guide ring is used instead of the flange—provides larger flexibility when the roller cutter during boring becomes inclined relative to the bearing shaft, thereby reducing the slip of the rollers against the race.

2. A single race means that all rollers are used to carry load during boring. Two races mean that one roller cannot be fully used, since this would require economically unacceptable high tolerances.

3. A single race means that a larger race for each roller is obtained since only two grinding clearances instead of four are required.

4. A roller bearing having a single race can be made narrower than a roller bearing having two races since the loose guide ring can be made thinner than the flange. The flange must have a considerably large width due to problems otherwise arising during the required heat treatment. Alternatively, for a predetermined overall race width larger rollers can be used in a single race design. The above and other objects of the invention are attained by giving the invention the characterizing features stated in the claims following hereinafter.

The invention is described in detail below with reference to the accompanying drawings in which one embodiment of the invention is shown by way of example. It is to be understood that this embodiment is only illustrative of the invention and that various modifications thereof may be made within the scope of the claims following hereinafter.

In the drawings

Figure 1:
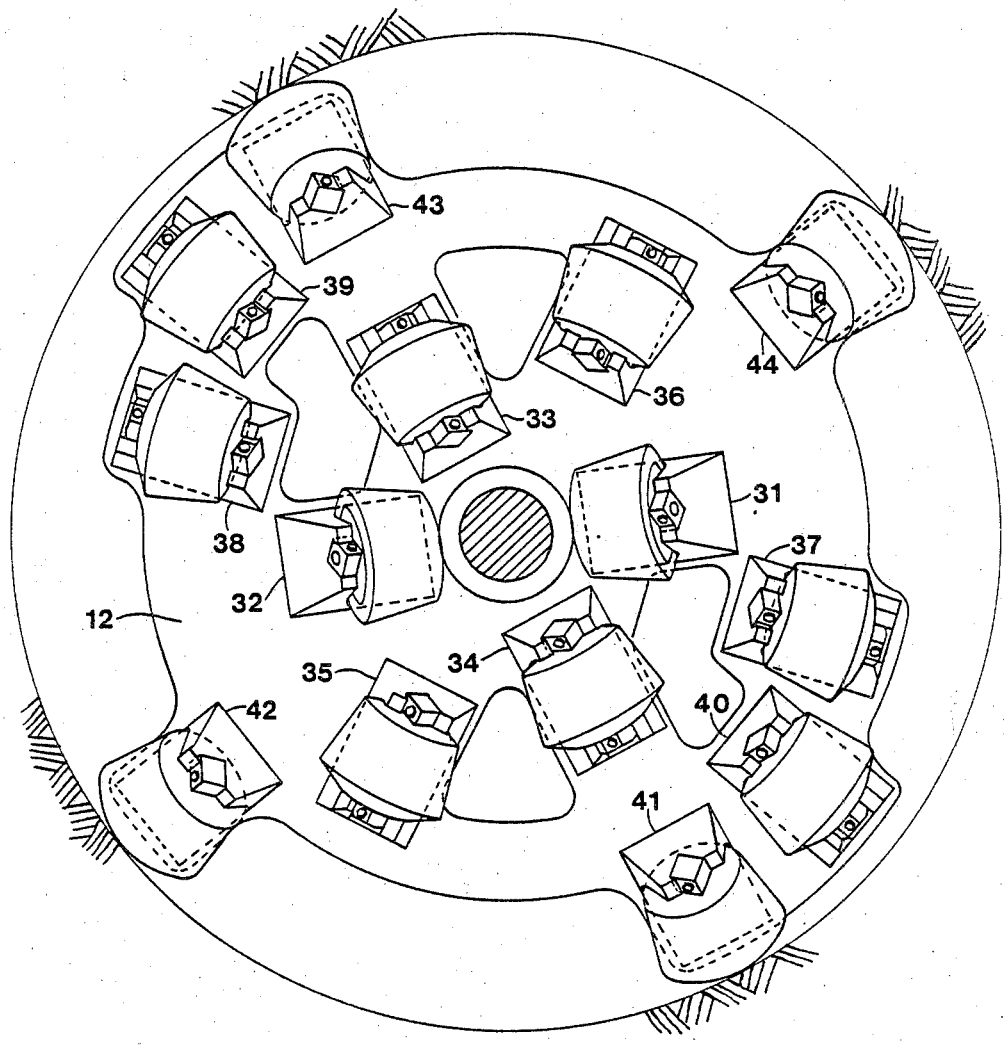
FIG. 1 is a plan view of a boring head according to the invention.
Figure 2:
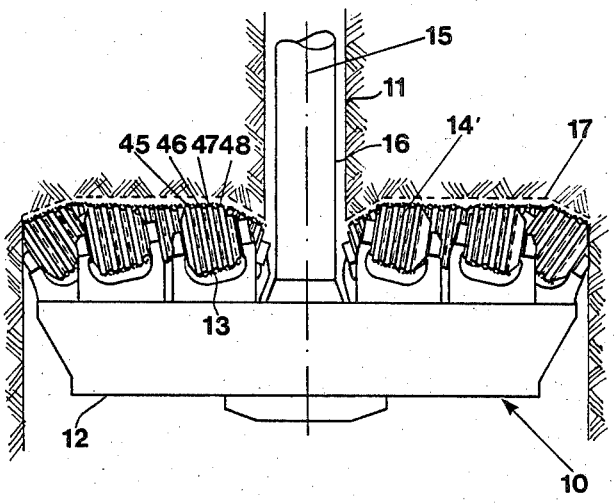
FIG. 2 is an elevational view of the boring head in FIG. 1, in which several of the roller cutters are rotated from their positions according to the patterned array of FIG. 1 and superimposed upon one another to illustrate the face-engaging position each roller cutter assumes upon rotation of the boring head.
Figure 3:
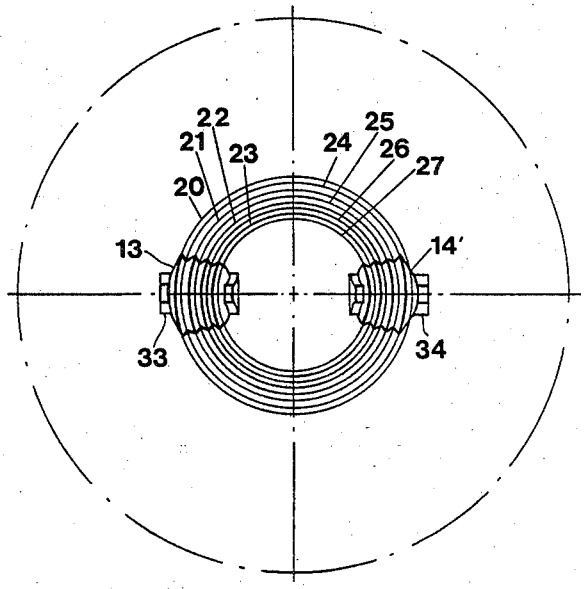
FIG. 3 is a top view of the boring head in FIG. 2; for the sake of clarity, however, only two roller cutters are shown together with the circles along which the cutting means on these roller cutters move during the rotation of the boring head.
Figure 4:
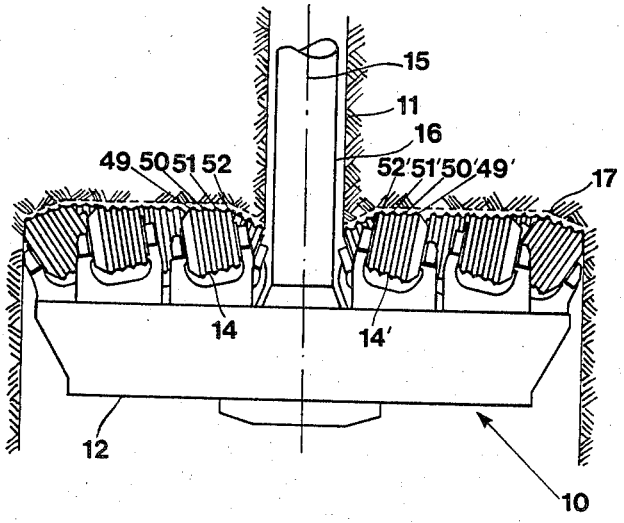
Figure 5:
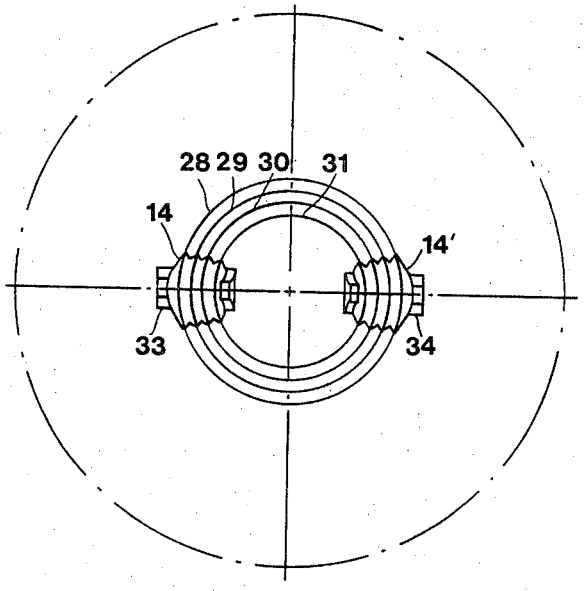

FIGS. 4 and 5, which correspond to FIGS. 2 and 3, show the boring head having a large row distance.

Figure 6:
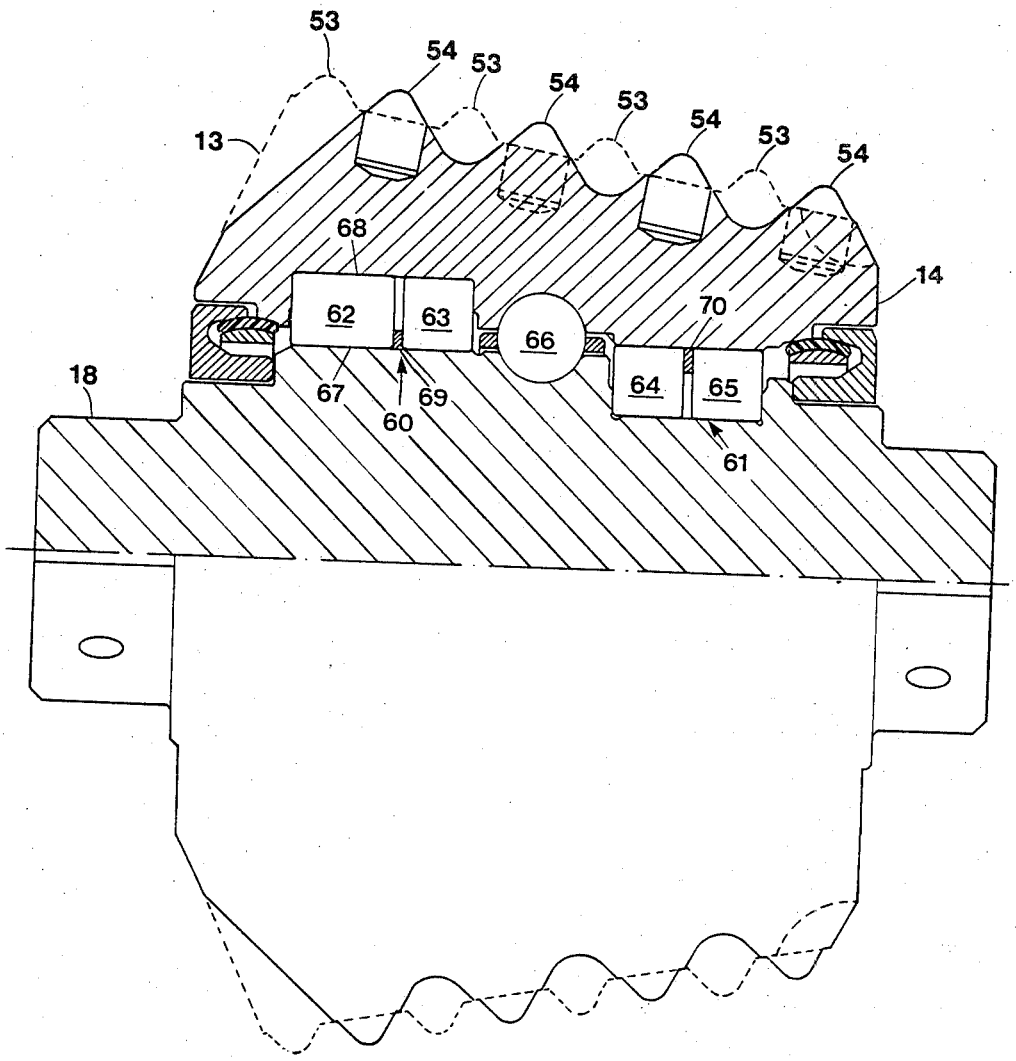

FIG. 6 shows, partly in section, a roller cutter of one set of cutters, and the contourlines of a roller cutter of another set of cutters provided with the improved bearing system according to the invention.

In the drawings, a pilot hole 11 pre-drilled in conventional manner between an upper level and a lower level, not shown, in a mine is reamed by means of a boring head generally depicted by the reference numeral 10. The boring head 10 comprises a body 12 on which a plurality of roller cutters 13, 14, in the illustrated embodiment to a number of fourteen, are mounted in mounting means or saddles 31–44. A rotary drive stem 16 is attached to the body 12. The boring head 10 is rotated and forced against an annular surface 17 surrounding the pilot hole 11 by means of the stem 16.

The saddles 31–44 are mounted in pairs on each side of the rotational axis 15 of the boring head 10 and at the same distance from the axis 15. The roller cutters 13, 14 are rotatably journalled in the saddles 31–44 by means of a shaft 18, FIG. 6. In a manner known per se, the innermost pair of roller cutters in the saddles 31, 32 are positioned in such a way that their shafts 18 are at an acute angle to the rotational axis 15, the two outermost pairs of roller cutters in the saddles 41, 43 and 42, 44, respectively, are positioned in such a way that their shafts 18 are at an obtuse angle to the axis 15, and the intermiediate pairs of roller cutters in the saddles 33–40 are positioned in such a way that their shafts 18 are at angles to the axis 15 varying between these limits such that a generally convex cutting surface 17 is produced.

In the illustrated embodiment, the boring head 10 comrises two sets of roller cutters 13, 14. A roller cutter 13 of the first set has cutting means 53 in form of hard metal inserts which are fitted in bores in the body of the roller cutter. The inserts 53 are positioned in rows 45–48 which extend circumferentially around the roller cutter. The rows 45–48 are mutually displaced in the longitudinal direction of the roller cutter. A roller cutter 14 of the second set of cutters has in similar manner cutting means 54 positioned in rows 49–52. All the roller cutters in one and the same set of cutters have the same number of rows of cutting means.

During rotation of the boring head 10 the cutting means 53, 54 on the roller cutters 13, 14 will move along concentric circles. For the sake of clarity only those circles are shown in FIGS. 3 and 5 along which the cutting means on the roller cutters in one of the pair of saddles 33, 34 move. The cutting means 53 on the roller cutter 13 mounted in the saddle 33, see FIG. 3, move along circles 20–23. The cutting means 54 on the roller cutter 14 mounted in the saddle 33, see FIG. 5, move along circles 28–31. As shown in FIG. 6, the cutting means 54 on the roller cutters 14 are located between the cutting means 53 on the roller cutters 13. Since the shafts 18 of the roller cutters 13, 14 are identical, this means that the radii of the circles 20–23 are different from the radii of the circles 28–31.

In order to obtain the smaller row distance in the illustrated embodiment, see FIGS. 2 and 3, roller cutters 13 of the one set of cutters are mounted in the saddles 31, 33, 35, 37, 39, 41 and 43. Roller cutters 14 of the other set of cutters are mounted in the saddles 32, 34, 36, 38, 40, 42 and 44. Thus, a roller cutter from each set of cutters is mounted in each pair of saddles. The rows of cutting means are positioned on the roller cutters 13, 14 in such a way that a circle, for instance the circle denoted by 21, along which one of the rows of cutting means on the roller cutter 13 moves is substantially half-way between two consecutive circles, in this case the circles denoted by 24 and 25, along which the rows of cutting means on the roller cutter 14 move. Due to the fact that all the saddles are positioned in pairs at the same distance from the rotational axis 15, circles are produced for all the pairs of saddles during rotation of the boring head 10 which circles are positioned in mutually similar manner.

In order to obtain the larger row distance in the illustrated embodiment, see FIGS. 4 and 5, roller cutters 13 are mounted in the saddles 39, 40, 42, 43 and 44. Roller cutters 14 are mounted in the saddles 31, 32, 33, 34, 35, 36, 37 and 38. In each pair of saddles, thus, a roller cutter of one and the same set of cutters is mounted. This means that two rows of cutting means, for instance the cutting means on the roller cutters 14, 14[1] in FIG. 5, will move along the same circle.

When the row distance is to be increased, and thus the overall number of concentric circles are to be decreased along which the cutting means on the boring head 10 move during the rotation of the head 10, then roller cutters 13 mounted in the saddles 31, 33, 35, and 37 are replaced by roller cutters 14. At the same time roller cutters 14 mounted in the saddles 40, 42 and 44 are replaced by roller cutters 13. When the row distance is to be decreased, the one of two cutters of the same set of cutters, for instance of type 14 in the saddles 33, 34, is replaced by a roller cutter of the other set of cutters, in this case a roller cutter of type 13.

The number of the rows of cutting means on the roller cutters 13, 14 are the same. This means that the forces acting on the boring head 10 are balanced if roller cutters of the same as well as of different sets of cutters are mounted in one of the pair of saddles. By suitably chosing the patterned array of roller cutters on the boring head 10, however, it is possible to satisfactorily balance the forces acting on the boring head even if the number of rows of cutting means on the roller cutter 13 are larger than the number of rows of cutting means on the roller cutters 14.

The roller cutter 14 is rotatably journalled on the bearing shaft 18 over a bearing system which comprises a roller bearing 60, an intermediate ball bearing 66 and a roller bearing 61. The roller bearing 60 has rollers 62, 63 which are spaced in the longitudinal direction of the roller cutter. According to the invention the rollers 62, 63 have common races 67, 68 on the bearing shaft 18 and the roller cutter 14. The diameter of the first race 67 is smaller than that of the second race 68. A loose guide ring 69 is located between the rollers 62, 63. In similarity the roller bearing 61 comprises rollers 64, 65 separated by a loose guide ring 70.

The cutting surface of the roller cutter is conical. Therefore, preferably, the roller bearings 60, 61 have different diameters. In the preferred embodiment the guide ring 69 in the larger roller bearing 60 is arranged at the inner race 67 and the guide ring 70 in the smaller roller bearing 61 is arranged at the outer race on the roller cutter 14.

In cross section the guide rings 69, 70 are rectangular. According to the invention the cross sectional height thereof is smaller than half the diameter of the rollers. The width of the guide rings is smaller than the cross sectional height thereof, preferably in the order of half the height.

We claim:

1. A rotary boring head for boring the face of earth formations, said boring head being of the type comprising a mounting means, a plurality of bearing shafts carried by said mounting means, and a plurality of roller cutters rotatably journaled on said shafts by a bearing system which comprises at least a first bearing set including a plurality of rollers spaced apart in the longitudinal direction of the respective roller cutter, the improvement, wherein:

said bearing shaft has a first race of a first diameter, said roller cutter having a second race of a second diameter larger than said first diameter, said longitudinally spaced rollers of said first bearing set being seated between said first and second races such that said first and second races are common to said longitudinally spaced rollers, and a guide ring disposed between said longitudinally spaced rollers and being loosely mounted relative to said bearing shaft and said roller cutter.

2. A boring head according to claim 1, wherein the guide ring is arranged adjacent to the first race on the bearing shaft.

3. A boring head according to claim 1, wherein the guide ring is arranged adjacent to the second race on the roller cutter.

4. A rotary boring head according to claim 1, wherein longitudinal movement of said roller cutter relative to said bearing shaft is unrestrained by said rollers, a plurality of ball bearings provided in races in said roller cutter and said bearing shaft for restraining longitudinal movement of said roller cutter relative to said bearing shaft.

5. A boring head for rotary boring of the face of earth formations comprising a plurality of roller cutters which are rotatably journaled on bearing shafts over a bearing system, said bearing shaft being carried by a mounting means on the boring head, said bearing system comprising a roller bearing having rollers which are spaced in the longitudinal direction of the roller cutter, characterized in that the rollers have common races on the bearing shaft and on the roller cutter, and in that a guide ring is arranged between the spaced rollers, said guide ring being loose with respect to the bearing shaft and the roller cutter, the bearing system comprises two roller bearings, said roller bearings being arranged at opposite ends of the roller cutter and having different diameters, characterized in that the guide ring of the larger roller bearing is arranged adjacent to the race thereof on the bearing shaft, and that the guide ring of the smaller roller bearing is arranged adjacent to the race thereof on the roller cutter.

6. A boring head for rotary boring of the face of earth formations comprising a plurality of roller cutters which are rotatably journaled on bearing shafts over a bearing system, said bearing shaft being carried by a mounting means on the boring head, said bearing system comprising a roller bearing including rollers which are spaced in the longitudinal direction of the roller cutter, characterized in that the rollers have common races on the bearing shaft and on the roller cutter, and in that a guide ring is arranged between the spaced rollers, said guide ring being loose with respect to the bearing shaft and the roller cutter, the height of the guide ring when measured at a race adjacent thereto is smaller than half the diameter of a roller.

7. A boring head according to claim 6, wherein the width of the guide ring is smaller than the height thereof when measured at a race.

8. A boring head according to claim 6, wherein the width of the guide ring is about one-half its height.

* * * * *